US005208959A

United States Patent [19]

Rosier et al.

[11] Patent Number: 5,208,959

[45] Date of Patent: May 11, 1993

[54] OFFSET NOSE ASSEMBLY WITH PIN RELEASING ASSEMBLY FOR FASTENER INSTALLATION TOOLS

[75] Inventors: Hendrik E. Rosier; Robert B. Wilcox, both of Kingston, N.Y.

[73] Assignee: Huck Patents, Inc., Wilmington, Del.

[21] Appl. No.: 698,525

[22] Filed: May 10, 1991

[51] Int. Cl.[5] ..... B21J 15/18

[52] U.S. Cl. ..... 29/252; 72/391.2

[58] Field of Search ..... 29/243.53, 252; 72/391.2, 391.4, 391.8

[56] References Cited

U.S. PATENT DOCUMENTS 3,593,401 7/1971 Chirco ..... 29/252
4,796,455 1/1989 Rosier ..... 72/391.2
4,979,279 12/1990 Garvey ..... 72/391.2
4,989,442 2/1991 Rosier ..... 29/243.53

*Primary Examiner*—J. J. Swann
*Attorney, Agent, or Firm*—Harness, Dickey & Pierce

[57] ABSTRACT

An offset pin puller apparatus usable with a fluid-operated actuator tool for exerting an axial pulling force on a grooved fastener pin projecting through a workpiece. Jaws mounted within the apparatus are held against axial motion while an associated collet moves axially to cam the jaws into clamped engagement with the fastener pin. The jaws are released from the fastener pin by abutment of a jaw release assembly with an inner wall of the apparatus. Such abutment effects an axial and radial separation of the jaws from the collet during a return stroke of the actuation tool.

20 Claims, 1 Drawing Sheet

OFFSET NOSE ASSEMBLY WITH PIN RELEASING ASSEMBLY FOR FASTENER INSTALLATION TOOLS

BACKGROUND OF THE INVENTION

1. Field of the Invention

This invention relates to an apparatus for exerting a pulling force on a grooved fastener pin extending through aligned holes in facially engaged workpieces. A jaw structure engageable with the fastener pin is radially offset from the axis of a piston actuated installation tool that is used to provide the operating force for pulling the fastener pin through the workpieces. The radial offset enables a nose portion of the apparatus to extend into partially obstructed clearance spaces that would not otherwise accommodate the nose portion is the nose portion were in direct axial alignment with the piston-cylinder axis of the tool.

2. Description of Prior Developments

A typical pin puller nose assembly includes an anvil housing having an annular nose portion adapted to engage a workpiece or a collar surrounding a grooved portion of a fastener pin that projects axially beyond the workpiece or collar. A segmented jaw structure is located within the nose portion of the anvil housing to grip the projecting portion of the pin for exerting an axial pulling force thereon.

The jaw structure is mounted within a collet that can move axially away from the workpiece or collar to initially clamp the jaw structure onto the grooved pin and to thereafter draw the jaw structure away from the workpiece surface. Axial movement of the collet is effective to either pull the pin through the workpiece and/or swage a fastener collar onto the fastener pin, depending on the particular usage of the apparatus.

The jaw structure segments typically include convergent nose surfaces axially aligned with an internal conical surface on the collet. As the collet moves away from the workpiece its internal conical surface exerts a camming action on the convergent nose surfaces of the jaw segments, thereby forcing the jaw segments to move radially inwardly so that teeth on the jaw segments exert gripping forces on the grooves of the fastener pin. The jaw structure is freely mounted within the collet so that initially the jaw segments are prevented from axial motion primarily by a relatively loose interlocking of the jaw segment teeth with the grooves in the fastener pin.

Under some conditions this loose interlocking fit of the jaw teeth in the fastener pin grooves is not fully effective to prevent undesired axial motion of the jaw structure such as occurs when the jaw segments slip axially along the pin surface. Such axial slippage is undesirable in that it requires the pin to be longer than it might otherwise have to be if the slippage did not have to be taken into account.

Aforementioned U.S. Pat. No. 4,989,442 provides a structural arrangement for preventing the undesired slippage of the jaw segments on the grooved fastener pin. The arrangements depicted in that patent application are structurally configured as in-line constructions wherein the nose of the anvil housing is in axial alignment with the axis of the piston-cylinder tool that is used to provide the operating force for the pin puller apparatus. Such an arrangement is not capable of operation in hard to reach applications requiring an offset nose configuration.

SUMMARY OF THE INVENTION

The present invention is directed to offset nose assemblies for installing fasteners, i.e. nose assemblies that are radially offset from the piston-cylinder axis of the installation tool which drives the nose assemblies. The radial offset facilitates or enables usage of the installation tool in partially obstructed clearance spaces. A jaw structure is axially biased so that, upon initial actuation of the tool piston, the jaw structure is held motionless relative to the nose assembly housing so that the teeth of the jaw segments cannot slip axially along the grooved pin surface. As a result, only a relatively slight axial motion of the collet is required to move the jaw structure into engagement with the pin.

Since there is virtually no axial slippage between the pin and jaw segments, the pin can be somewhat shorter than the pins that are usually used in offset applications. This is advantageous from a cost standpoint and also from an axial clearance standpoint. The axial clearance between the end of the pin and any in-line obstruction thereby becomes less of a limiting factor on usage of the fastener pin in limited tool access applications.

An apparatus somewhat related to the present invention is shown in U.S. Pat. No. 4,989,442 entitled "Nose Assembly For Pulling Fasteners Through Interference Fit Holes". Although the present invention may be used for similar applications, it is also applicable to fastening apparatus used for swaging a fastener collar into the grooves on a fastener pin extending through aligned workpieces. Such an apparatus is shown in U.S. Pat. No. 4,598,572 entitled "Apparatus And Gripping Jaw Assembly For Setting Fasteners".

THE DRAWINGS

DESCRIPTION OF THE PREFERRED EMBODIMENTS OF THE INVENTION

Figure 1:
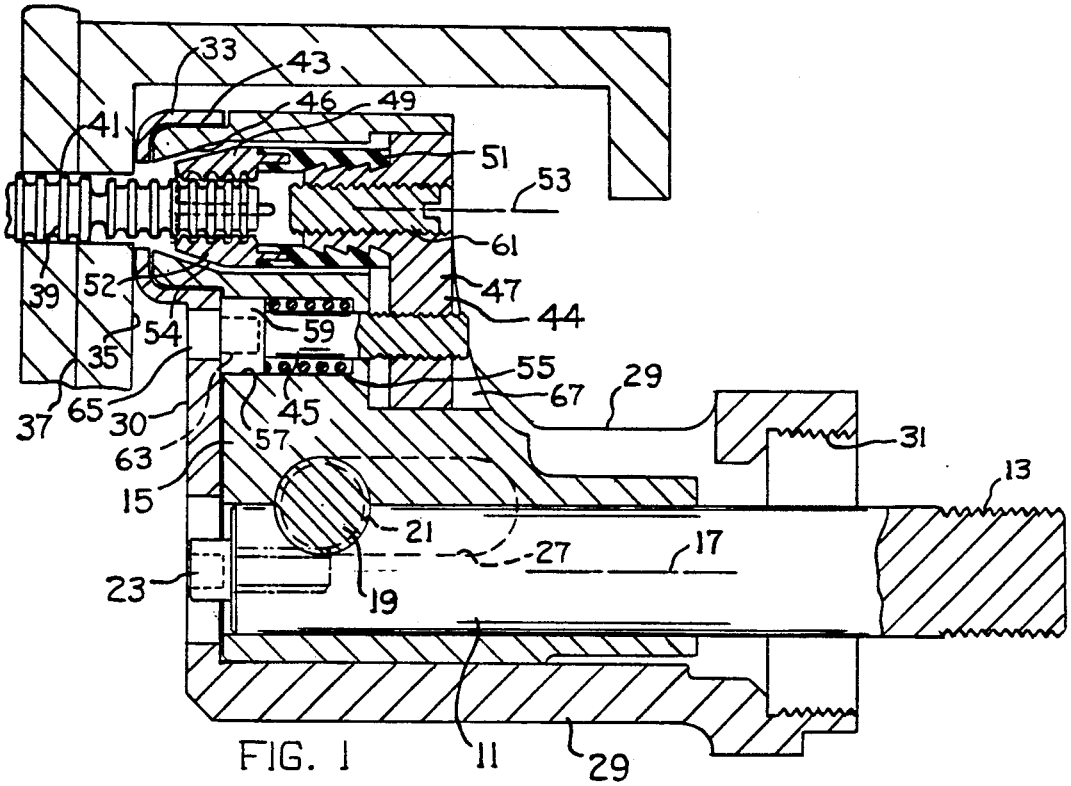
FIG. 1 is a sectional view taken through an apparatus embodying features of the invention.

FIG. 1 of the drawings shows an apparatus 10 that includes a cylindrical drawbar 11 having a threaded section 13. The drawbar carries a collet 15 that extends radially from the drawbar axis 17. A transverse pin 19 extends through a semi-circular slot 21 in drawbar 11 and through two circular openings in the collet to secure the collet and drawbar together.

A socket head screw 23 extends axially through the drawbar into an annular groove 25 in pin 19, whereby pin 19 is prevented from transverse dislocation from the collet. End portions of pin 19 extend into slots 27 in the side walls of anvil housing 29, whereby the collet is guided for movement parallel to drawbar axis 17. The relation between the drawbar, collet and housing 29 is similar to the relationship depicted and described in U.S. Pat. No. 4,796,455.

Housing 29 has an internally threaded section 31 that is concentric with the threads on drawbar 11. In one arrangement the anvil housing may be directly threaded to the cylinder portion of a fluid-operated actuator tool and drawbar 11 may be directly threaded to the piston portion of the actuator tool, as indicated generally in U.S. Pat. No. 4,796,455.

In another arrangement concentric rotary adapters can be arranged between the tool components, i.e., the tool, cylinder and piston, and the illustrated puller components 11 and 29. The use of such adapters permits the puller apparatus to be rotatably adjusted around the drawbar axis 17, so that the puller apparatus can be offset in different directions, e.g. to one side, the other side, upwardly or downwardly, depending on the nature of the work installation. The tool operator can hold the actuator tool in a comfortable position without any awkward arm twisting in order to position the nose portion of the puller apparatus against the work.

Anvil housing 29 includes an offset annular nose 33 engageable against surface 35 of the workpieces 37 in surrounding relation to a grooved fastener pin 39 that projects through aligned circular holes 41 in the work. The purpose of the illustrated apparatus is to pull pin 39 rightwardly through the work to establish an interference fit between the pin and the edges of holes 41. The apparatus is an alternative to the use of hammers or other similar devices referenced in aforementioned U.S. Pat. No. 4,989,442.

Collet 15 extends radially and upwardly from drawbar 11 within housing 29. An annular section 43 of the collet is located within nose 33 to define a space for receiving the projecting portion of pin 39. The collet serves as a mounting for a pin engaging jaw structure designated generally by numeral 44. This jaw structure is a multi-piece assembly which includes a plunger 45, an arm structure 47 extending upwardly from the right end of plunger 45, and a segmented jaw assembly 49 extending leftwardly from arm structure 47 into the space circumscribed by annular collet section 43.

Segmented jaw assembly 49 is constructed similarly to the segmented jaw shown in U.S. Pat. No. 4,598,572. Jaw assembly 49 includes an elastomeric tube 51 attached at its right end to a barbed projection 50 on arm structure 47, and three jaw segments 52 attached to the left end of tube 51. The jaw segments can move radially toward or away from nose axis 53, i.e., to or from clamped positions in engagement with pin 39.

Movement of the jaw segments into engagement with pin 39 is effected by a rightward axial motion of collet section 43. Thus, when the actuator tool is operated to move collet 15 in a rightward direction, an internal conical surface 46 on collet section 43 moves against the frustoconical surfaces 54 on jaw segments 52 to cam the jaw segments into engagement with fastener pin 39.

After the jaw structure is clamped to pin 39, further rightward motion of the drawbar-collet assembly enables pin 39 to be drawn rightwardly through the workpieces and to establish an interference fit between the pin and edge areas of holes 41. The left end face of nose 33 is in pressure engagement with the work surface 35 to form a reaction base or anchorage for the pin pulling action.

An important feature of the invention is the construction of jaw structure 44 and its coaction with collet 15 such that during the initial motion of the collet away from workpieces 37, a coil spring 55 maintains jaw structure 44 motionless relative to anvil housing 29. The associated plunger 45 is slidably mounted within a cylindrical slideway 57 extending within collet 15 parallel to drawbar axis 17.

Head 59 of the plunger abuts against the right interior face of housing wall 30 so that during the initial rightward motion of the collet, the plunger 45 is held against the housing wall by spring 55 as the spring expands axially. The associated arm structure 47 and jaw segments 52 remain motionless while annular collet section 43 is moving toward surfaces 54 of the jaw segments. After the jaw segments have been cammed into clamped engagement with the fastener pin, the jaw structure 44 moves as a unit with collet 15.

The jaw structure may be disengaged from the fastener pin after it has been pulled rightwardly to its final position of maximum projection through the work. The disengagement process begins with a return stroke of the installation tool causing a leftward motion of the collet until the collet is in its initial position as seen in FIG. 1.

When head 59 on plunger 45 abuts against the inner face of housing wall 30, the jaw structure 44 is axially halted in its forward movement and is thereby disengaged from the fastener pin, as shown in FIG. 1. The collet continues its forward movement leftwardly to complete its return stroke thereby axially and radially separating the collet surface 46 from the jaw surfaces 54. The apparatus 10 is then removed from the pin by a rightward bodily movement of the entire apparatus.

The apparatus 10 can include a device for limiting the initial protrusion of the fastener pin into the jaw assembly, thereby ensuring that the jaw segments are properly located at the extreme end of the pin for proper pin engagement. As shown in FIG. 1, the pin-projection limiter includes a set screw 61 threadably mounted in arm structure 47 through a threaded bore formed through barbed projection 50. Screw 61 can be axially adjusted to provide different pin-projection limits. The pin could be fixed to the arm structure if adjustability was deemed unnecessary.

Apparatus 10 includes an adjustable connection between the shank of plunger 45 and the arm structure 47. Threads 60 are formed on the right end of the plunger shank, such that the plunger can be manually rotated around its axis within cylindrical slideway 57 to axially move and adjust arm structure 47 leftwardly or rightwardly, depending on the direction in which the plunger is turned. A hexagonal socket 63 is formed in plunger head 59, whereby a hexagonal allen wrench can be inserted through hole 65 in wall 30 for turning the plunger to axially adjust the position of arm structure 47.

Adjustment of arm structure 47 is for the purpose of adjusting the axial spacing of conical surface 46 of collet 15 with respect to jaw surfaces 54. It is desirable to have this axial spacing relatively small, without having to use inordinately small axial tolerances during the manufacturing process. The axial adjustment of arm structure 47 compensates for manufacturing and assembly tolerances and also for the fact that the threaded connections at 13 on the drawbar 11 and at 31 on the anvil housing 29 may not always establish the same precise axial spacing between the anvil and collet along nose axis 53.

Arm structure 47 is intended to be a nonrotary component such that jaw structure 44 has the desired axial alignment with collet surface 46. To preclude any undesired rotation of the arm structure around the axis of plunger 45, the arm structure is dimensioned so that its side edges are in close engagement with internal side surfaces of the collet side walls 67. Arm structure 47 nests within a hollow, somewhat rectangular, space formed between the collet side walls.

Figure 2:
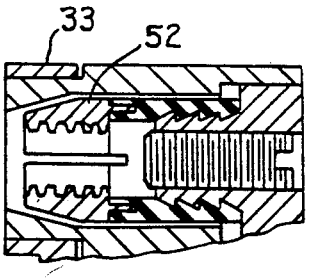
FIG. 2 shows a fragmentary sectional view of an alternate structural detail that can be used in the FIG. 1 apparatus.

FIG. 2 fragmentarily illustrates a structural detail that can be used in the FIG. 1 apparatus. As shown in FIG. 2, nose 33 is configured as an open cylinder. There is no inturned flange, as in the FIG. 1 nose construction. The annular end edge 68 of the nose engages the work surface. This is advantageous in that the jaw segments 52 are nearer to the work surface when the apparatus is initially inserted over a projecting fastener pin. The pin can have a shorter rightward projection while still establishing a sufficient axial overlap of the jaw segments around the pin prior to rightward powered motion of the collet.

Figure 3:
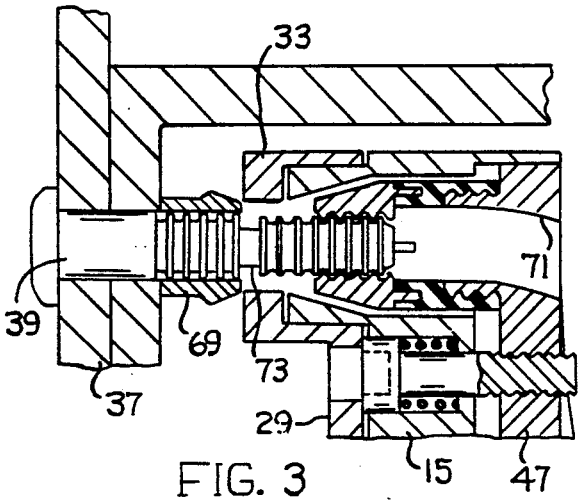
FIG. 3 is a fragmentary sectional view taken in the same direction as FIG. 1, but illustrating another structural configuration embodying the invention.

FIG. 3 fragmentarily illustrates the invention applied to an apparatus used for swaging a fastener collar 69 onto a fastener pin 39 that has already been drawn through the work, e.g., by the apparatus shown in FIG. 1. The components used in the FIG. 3 apparatus may be similar to that used in the FIG. 1 apparatus, except that the inturned flange on nose 33 should preferably be somewhat thicker in the axial direction in order to withstand the swaging pressures.

In operation of the FIG. 3 apparatus, rightward motion of collet 15 causes the jaw structure to be clamped to the fastener pin in the fashion described previously per FIG. 1. Anvil housing 29 moves reactively to the left to exert a swaging force on collar 69. A hole 71 is formed through arm structure 47 for ejection of the pintail that is severed from the fastener pin at conclusion of the collar swaging operation. Numeral 73 designates the breakneck groove that constitutes the separation point between the fastener pin and the pintail.

The invention relates primarily to the construction of the offset jaw structure 44 and to the actuation and release of the jaw segments. Specifically, the jaw segments remain essentially axially motionless while the collet is initially moving to force the jaw segments into clamped engagement with the fastener pin. The jaws are subsequently released from the fastener pin by axially halting the forward movement of the arm structure 47 during the return stroke of the collet. The offset nose assembly minimizes potential axial slippage between the jaw segments and the fastener pin by allowing the jaws to be positioned quite close to the front end of the nose assembly and thereby permit shorter pins to be used. When the installation space is partially obstructed, as in FIG. 1, this can be a significant advantage.

Obviously, numerous modifications and variations of the present invention are possible in the light of the above teachings. It is therefore to be understood that within the scope of the appended claims, the invention may be practiced otherwise than as specifically described herein.

What is claimed is:

1. An apparatus for exerting an axial pulling force on a fastener pin having an axis and extending through a workpiece, said apparatus comprising:

a housing;

a drawbar positioned within said housing and having an axis and being connected to a fluid-operated actuator tool for relative motion along an actuator axis radially offset from the fastener pin;

a collet carried by said drawbar for movement therewith;

a segmented jaw structure having an axis radially offset from said drawbar axis and mounted on the collet for exerting a pulling force on the fastener pin, said collet having surface areas thereof aligned with said jaw structure so that axial motion of said collet is effective to radially move said jaw structure into clamped engagement on the fastener pin; and biasing means radially offset from said jaw structure axis for axially biasing said jaw structure relative to said collet and said housing so that during initial motion of said collet away from the workpiece said segmented jaw structure remains in a fixed position relative to said housing.

2. The apparatus of claim 1, wherein said collet includes a slideway extending parallel to the fastener pin axis and wherein said jaw structure comprises a plunger means having an axis and moveable in said slideway into abutment with said housing.

3. The apparatus of claim 2, wherein said jaw structure further includes an arm structure extending radially from said plunger means transversely across said jaw structure.

4. The apparatus of claim 3, further comprising an adjustable connection between said plunger means and said arm structure whereby said arm structure can be moved in a direction parallel to said plunger means axis without changing the axial position of said plunger means.

5. The apparatus of claim 1, wherein said collet includes a linear slideway extending parallel to the fastener pin axis at an intermediate point between said drawbar axis and the fastener pin axis; said jaw structure comprising a plunger means slidably positioned in said slideway, an arm structure extending from said plunger means transversely across said jaw structure axis, and a number of jaw segments carried by said arm structure for radial motion between a first condition disengaged from the fastener pin and a second condition clamped against the fastener pin.

6. The apparatus of claim 5, wherein said plunger means comprises a cylindrical head and a cylindrical shank extending from said head through said arm structure, said shank having a threaded connection with said arm structure whereby rotation of said plunger means around its axis causes said arm structure to move in a direction parallel to said slideway axis.

7. The apparatus of claim 6, wherein said biasing means is a coil spring encircling said shank portion of said plunger means.

8. An apparatus for exerting an axial pulling force on a fastener pin extending through a workpiece, said apparatus comprising: a threaded drawbar connected to a piston portion of a fluid-operated actuator tool to define an actuator axis, a housing having a threaded section concentric with drawbar threads whereby said housing is connectable to a cylinder portion of said actuator tool, said housing having a hollow tubular nose having an outer end surface adapted to engage a surface of the workpiece, said nose being centered on a nose axis that is parallel to said actuator axis but offset therefrom, whereby said nose can be located in partially obstructed spaces, a collet carried on said drawbar and movable within said housing, said collet having an annular section located within said nose to define a space for receiving the fastener pin, a slideway extending through said collet on an axis that is parallel to said actuator axis and said nose axis, with said slideway being offset from said actuator axis and said nose axis, a jaw structure comprising a slide member slidably mounted in said slideway along a slideway axis, a biasing means biasing said slide member relative to said collet and said housing and into abutment with a wall of said housing, and a plurality of jaw segments located within said annular section of said collet, said jaw segments being operatively aligned with an internal surface of said annular section of said collet so that during initial motion of said collet away from the workpiece said basing means maintains said jaw structure in a motionless condition until said collet internal surface is in contact with said jaw segments, after which said jaw segments are forced into engagement with the fastener pin.

9. The apparatus of claim 8, wherein said slide member comprises a plunger, said plunger having a head and a shank extending from said head away from said housing wall, said biasing means comprising a coil spring encircling said shank of said plunger to bias said plunger toward said housing wall.

10. The apparatus of claim 9, and further comprising an arm structure extending from said plunger transversely across said nose axis, said jaw segments being carried by said arm structure for radial motion between a first condition disengaged from the fastener pin and a second condition clamped against the fastener pin.

11. The apparatus of claim 10, wherein said plunger shank has a threaded connection with said arm structure, whereby rotation of said plunger adjusts said arm structure in a direction parallel to said slideway axis.

12. The apparatus of claim 10, wherein said annular section of said collet has an internal conical surface in axial registry with outer surfaces of said jaw segments, whereby axial motion of said collet in one direction enables said collet conical surface to cam said jaw segments radially inwardly to a condition clamped against the fastener pin.

13. The apparatus of claim 10, wherein said collet comprises internal side surfaces engaged with side edges of said arm structure for preventing said arm structure from rotating around said plunger axis.

14. An offset nose assembly for pulling a fastener pin, comprising:

a housing connectable to an actuator tool;

said housing having a forward nose portion and a rearward connecting portion with said rearward connection portion being connectable to said actuator tool;

a collet disposed within said housing for sliding movement between said nose portion and said connecting portion of said housing;

a drawbar connectable to an actuator tool piston and movable along a drawbar axis;

jaw means provided in said collet for gripping and pulling the fastener pin, said jaw means having an axis radially offset from said drawbar axis; and engagement means connected to said jaw means for engaging said housing and for limiting axial motion of said jaw means towards said forward nose portion of said housing during axial motion of said collet towards said forward nose portion of said housing.

15. The assembly of claim 14, wherein said engagement means comprises a spring-biased plunger slidably mounted within said collet and engageable with said wall of said housing.

16. The assembly of claim 14, wherein said engagement means is movable along an axis located between said drawbar axis and said jaw means axis.

17. The assembly of claim 14, wherein said jaw means comprises an axially-adjustable member for limiting insertion of said fastener pin within said jaw means.

18. The assembly of claim 14, wherein said engagement means comprises an arm connected to a rear axial portion of said jaw means.

19. The assembly of claim 18, wherein said engagement means further comprises a longitudinally slidable plunger connected to said arm.

20. The assembly of claim 19, wherein said longitudinally slidable plunger is axially adjustable with respect to said arm.

* * * * *